US006210320B1

(12) United States Patent
Rogone et al.

(10) Patent No.: US 6,210,320 B1
(45) Date of Patent: Apr. 3, 2001

(54) THERMAL AND HUMIDITY BARRIER FOR EXTREMELY PREMATURE INFANTS

(75) Inventors: Mary S. Rogone, Victorville; Austin J. Webber, II, La Verne, both of CA (US)

(73) Assignee: Small Beginnings, Inc., Victorville, CA (US)

( * ) Notice: Subject to any disclaimer, the term of this patent is extended or adjusted under 35 U.S.C. 154(b) by 0 days.

(21) Appl. No.: 09/053,346

(22) Filed: Apr. 1, 1998

(51) Int. Cl.[7] ..... A61G 11/00

(52) U.S. Cl. ..... 600/22; 600/21

(58) Field of Search ..... 5/100, 424; 600/21, 600/22; 128/872; 220/4.21, 662

(56) References Cited

U.S. PATENT DOCUMENTS 4,885,000 * 12/1989 Hogan ..... 600/21

* cited by examiner

*Primary Examiner*—Michael Peffley
*Assistant Examiner*—R. Kearney
(74) *Attorney, Agent, or Firm*—Skjerven Morrill MacPherson LLP; Theodore P. Lopez

(57) ABSTRACT

A thermal and moisture barrier device for use with a specialized heating and humidifying apparatus in the care of extremely premature neonatal infants. The thermal and moisture barrier comprises a collapsible and substantially flexible cover which defines an enclosed volume, large enough to accommodate an extremely premature neonatal infant. At least one flexible opening is located on a portion of the cover which communicates with the enclosed volume. A diaphragm provides closure of the flexible openings. The diaphragm is a resiliently flexible sheet extending across the opening and has slits.

14 Claims, 5 Drawing Sheets

THERMAL AND HUMIDITY BARRIER FOR EXTREMELY PREMATURE INFANTS

BACKGROUND OF THE INVENTION

1. Field of Invention

This invention relates generally to the treatment of extremely premature infants, and more specifically to an improved thermal barrier and its use for providing a neutral thermal environment.

2. Description of the Relevant Art

Maintenance of body temperature in premature infants is of critical importance to their health and survivability. At the present time, there are many infant warmers in use for the treatment and maintenance of babies. Such infant warmers typically include an overhead infrared heater, which is the source of the warmth for an infant placed in the warmer. Such devices usually offer an efficient means for rewarming infants who have been cold stressed, while allowing access to the infant for emergency resuscitation, diagnostic, and therapeutic procedures, and further enabling uninterrupted heat delivery for maintenance of body temperature during routine nursing and medical care.

While radiant warmers perform adequately in providing for the environmental needs of premature infants (30–36 weeks gestational age) or full-term infants (36 weeks and above gestational age), the needs of the extremely premature neonate are not sufficiently met. An extremely premature neonate, which has a gestational age of between 24 and 28 weeks, and/or a birth weight of less than 1,000 grams (1–2 lbs.), is subject to a degree of cold stress that a less premature or full-term infant does not experience. One of the most challenging aspects in caring for an extremely premature neonate is body temperature maintenance. The extremely premature neonate has very little ability to maintain its own body temperature. The extremely premature neonate is therefore extremely sensitive to environmental temperature changes. When an extremely premature neonate is subject to a volatile temperature environment, causing a decrease in body temperature, a spiraling coarse of reactions occur. Body metabolism rates increase in an attempt to raise body temperature. The metabolic increase, in turn, leads to increased oxygen consumption, which can be devastating to an extremely premature neonate who is already in a state of respiratory compromise due to its inherent lung prematurity. Caloric consumption is also increased, which is a critical factor to the well being of an already weight compromised infant (less than 1000 gm). Moreover, it is typical for an extremely premature neonate to have a very underdeveloped skin system. Because of the thin, gelatinous nature of the extremely premature neonate's skin, the neonate is at risk for significant insensible water loss which can effect every body system and can lead to dehydration with significant electrolyte and fluid imbalances and further weight loss.

To prevent these life threatening events from occurring, it is desirable that significant variation in the extremely premature neonate's environment be reduced to the extent possible. A neutral thermal environment with a constant temperature and humidity level is sought so that the extremely premature neonate's body systems are not in a constant struggle to adapt. The environment must occupy a relatively small volume, since even incubator volumes are relatively large and contain variations in temperatures and humidity that are considered too low and too variable. The environment must be maintained even when the patient is undergoing procedures or examination. In the past, various makeshift techniques have been used in an attempt to cover an extremely premature neonate exposed on a warmer bed, including enclosing the warmer bed in plastic wrap. However, the neutral thermal environment is continuously disturbed when frequent access to the patient is required. In the care of an extremely premature neonate, the acuity level of the neonate requires that the clinician have almost constant access.

In light of the above identified problems with the need to maintain a neutral thermal environment and a consistent humidity level for extremely premature infants, a device is needed that will create a thermal barrier around the patient which creates this consistent neutral environment. Moreover, the device must be designed such that access to the patient is made practical with minimal change to the humidity provided and the neutral thermal environment.

SUMMARY OF THE INVENTION

The present invention provides a moisture and thermal barrier for the maintenance of an improved neutral thermal and humidified environment when used with a specialized heating and humidifying apparatus. The device can surround an extremely premature neonate (less than 1000 gm and 24 to 28 weeks gestational age) to provide an environment with substantially constant temperature and humidity levels. Maintenance of the neutral thermal and humidified environment reduces insensible water loss in the infant and reduces excessive oxygen consumption. The thermal barrier may have covered flexible openings for manual access to the patient for conducting medical procedures. By eliminating the need for removing the barrier for patient access, air exchange and loss of heat, moisture, warmth, and humidity are substantially eliminated during almost the entire course of patient care. Advantageously, the barrier may be made from a clear, medium-weight, plastic-like material, to provide for complete and constant visualization of the patient. Moreover, the thermal barrier is suitable for use with X-ray and other visualization equipment.

In one aspect, a thermal and moisture barrier device for use with a specialized heating and humidifying apparatus in the care of extremely premature neonatal infants is provided. The barrier comprises a collapsible and substantially flexible cover which defines an enclosed volume, large enough to accommodate an extremely premature neonatal infant. Also provided is at least one flexible opening, located on a portion of the cover which communicates with the enclosed volume. Advantageously, a diaphragm provides closure of the flexible openings. The diaphragm is a resiliently flexible sheet extending across the opening and has slits.

In another aspect of the invention, the thermal and moisture barrier is used in conjunction with an incubator or similar device. The barrier can be a free-standing tetrahedral or right circular cylinder enclosure. An edge portion of the barrier can have an edge portion that creates a seal with a bed or other surface, when the device is placed over an extremely premature infant. A further understanding of the nature and advantages of the present invention may be realized by reference to the remaining portions of the specification and the drawings.

DESCRIPTION OF A SPECIFIC EMBODIMENT

Figure 1:
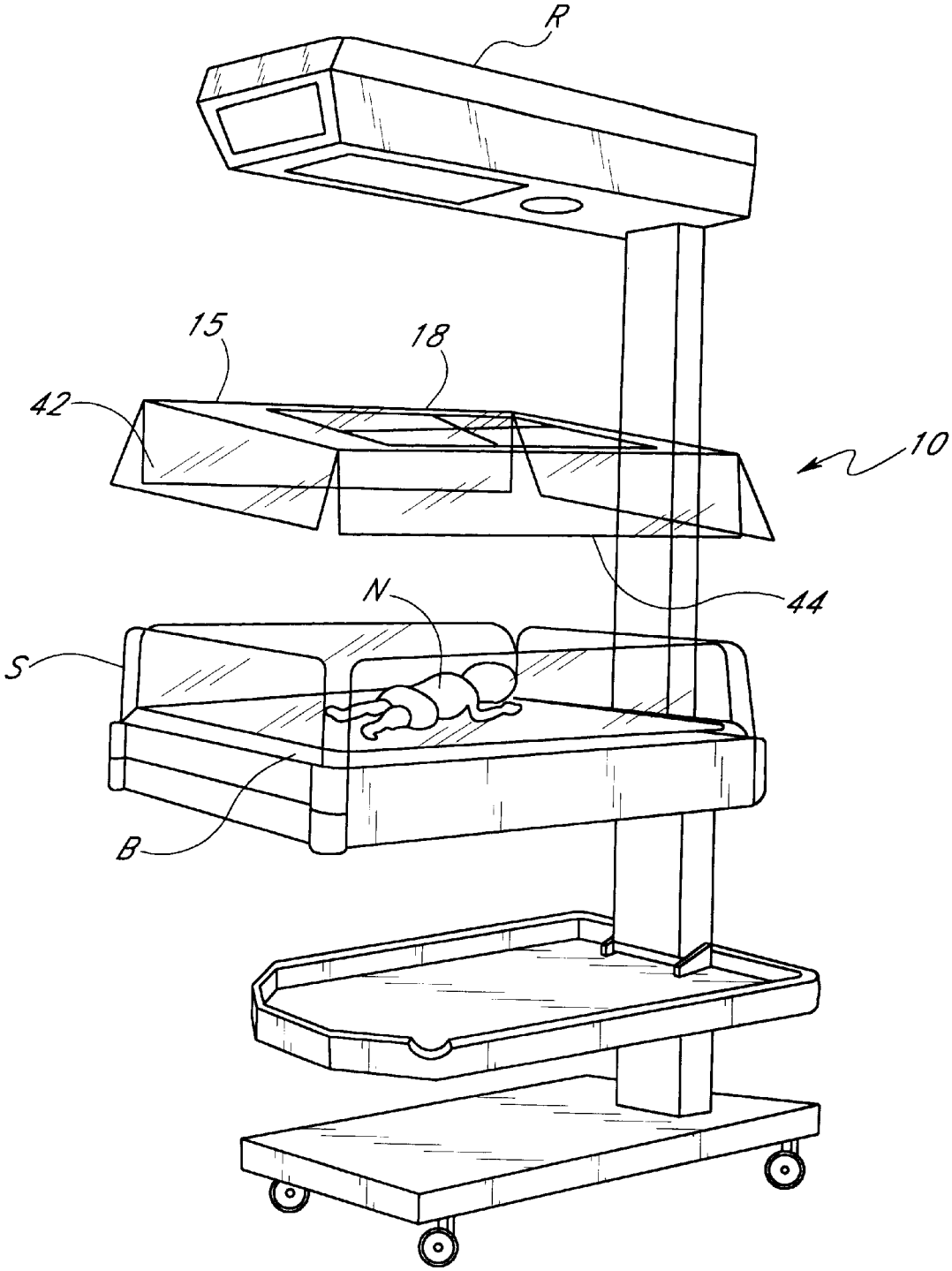
FIG. 1 is a perspective view of a thermal barrier according to the present invention shown above the bed of a radiant warmer prior to being placed in the preferred position.

The present invention provides a thermal and moisture barrier for maintaining an improved neutral thermal and humidified environment. Generally, a barrier is used with open radiant warmer beds or convection warmed infant incubators to provide a constant environment having consistent temperature and humidity levels. The barrier may be formed from a single sheet of flexible, clear plastic, vinyl, or similar material. In use, the barrier is placed completely over the infant, so that its inner surface is close to but does not contact the infants skin. Thus, the barrier is able to capture a volume of dead air space within the infant's micro-environment.

The thermal and moisture barrier is designed to retain its shape under the warming conditions of infrared lamps or the convective heat of an incubator. The barrier is easily and quickly placed over the infant where it is held in position either under its own weight, with weights added at an edge portion or with a securing means such as, pins, tape, Velcro strips, or any other suitable but temporary adhesive.

The barrier may be made from a flexible, resilient, medium weight material, such as plastic or the like, which can maintain its shape while subjected to warming conditions. Specifically, the material may be a 12 to 15 gauge flexible, clear plastic. While most plastic materials meet the structural requirement standards for the barrier, they are also inexpensive enough to be considered disposable. The inherent rigidity of the plastic is also desirable in that it enables the barrier to be easily cleaned and reused "if necessary." Furthermore, the barrier material can be cut or punctured to enable placement of, for example, respirator tubes, intravenous lines, and the like, without effecting the neutral thermal environment. It may be necessary to incorporate ridges or other structural enhancements to enable the overall barrier to be self-supporting, and not collapse over the infant. Such ridges are easily formed into most plastic materials and methods for forming such ridges are well known.

It has been observed that removal of a thermal barrier can quickly and drastically cause a reduction in the temperature surrounding the infant. Thus, drastically disturbing the neutral thermal environment. To prevent this, flexible, covered openings are provided for manual access of the patient. This allows immediate access to the infant within the barrier for suctioning, taking vital signs, and the like, while still maintaining the thermal environment surrounding the premature infant. When manual access to the patient is no longer necessary, a plastic covering, made of a resiliently flexible material, is made to overlap the flexible openings which enables the natural self-adhering tendency of the plastic materials to form a seal around the flexible openings.

The thermal and moisture barrier is preferably made from a clear material, so that it is transparent to the infrared lights that warm the infant, as well as being optically transparent for unobstructed and undistorted viewing of the infant. Even though optically clear, however, the barrier's material reduces sound levels within its totally enclosed confines, and thus serves to provide an acoustically sensory-deprived environment. This is felt to be desirable, especially in the active and sometimes loud environment of an intensive care nursery.

FIG. 1 illustrates a thermal and moisture barrier 10 placed over the bed portion B of a radiant warmer R. The barrier is sized and shaped to cover, but not touch, the extremely premature neonate N. The advantage of such an enclosure is that it creates a neutral thermal micro-environment which surrounds an extremely premature neonate. Generally, in one exemplary embodiment, the thermal barrier has a cover 15 and flap portions 42. Typically, flap portions 42 are made to overhang side panels S of radiant warmer bed B. Barrier 10 is designed to be held in place under its own weight, however, weights may be disposed in edge portion 44 to ensure that a constant seal is maintained. Access to the patient is provided through flexible openings 18 disposed on cover 15.

Figure 2:
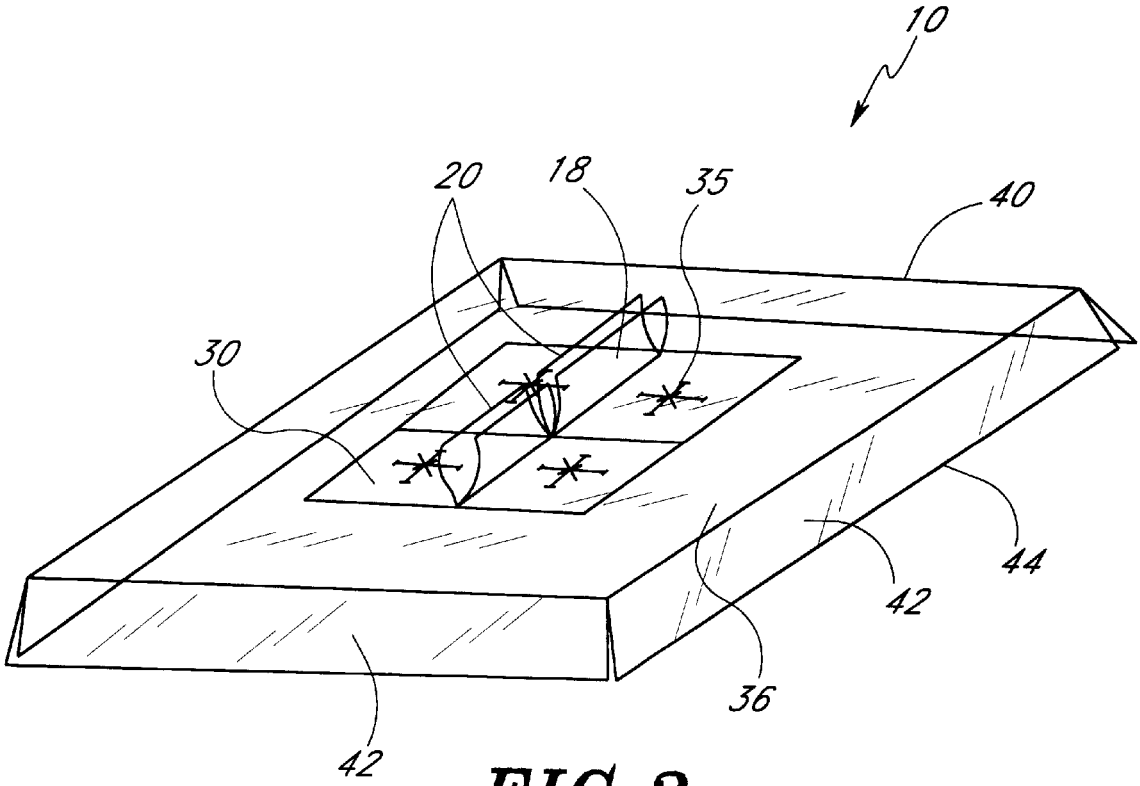
FIG. 2 is a perspective view of a specific embodiment of the present invention.

Referring now to FIG. 2 which illustrates a specific embodiment of the present invention. The thermal barrier is a substantially flexible cover 15 which defines an enclosure to accommodate a neonatal infant. The enclosure is created when cover 15 is placed over the bed portion of a radiant warmer. In the specific embodiment shown, the barrier is formed from a substantially rectangular sheet. The sheet has a flexible seam 40 which is coupled at each of its edges to flap portions 42. Seam 40 acts as a hinge, such that flap portions 42 are pivotally moveable. The seam is created using a heat seal, radiofrequency seal, or any other seal which may be suitable. The sheet may be substantially the same size as the bedding portion of the radiant warmer, such that flap portions 42 overhang side panels of the radiant warmer and create a substantially enclosed environment. The dimensions of the barrier may range from approximately 13 by 24 inches to 25 by 30 inches, depending on the size of the subject radiant warmer.

To ensure that the improved environment is maintained during the conducting of medically necessary procedures, cover 15 has at least one flexible opening 18 located on a portion of the cover. Opening 18 provides communication with the enclosed volume captured by the cover. The opening has a diaphragm 30 which provides closure of flexible opening 18 when it is not in use. Diaphragm 30 is a self-acting closing device, that opens and closes when a clinician's hand or an instrument is urged into the enclosed space. To create the diaphragm, a resiliently flexible material 30 is extended across opening 18 which has a plurality of slits 35. Slits 35 may be configured in any manner that provides the self-acting closing function, however, in a preferred configuration, the slits extend radially outward from the center of the opening and have a common junction point located substantially centrally of flexible opening 18. For added protection of the neutral thermal environment, diaphragm 30 may comprise a superposed sheet of flexible material 20, preferably plastic, for covering the diaphragm. Cover material 20 is secured on to cover 15 at a location proximate to openings 18 and overlaps diaphragm 30, including slits 35 and ensures that no air is either leaking in or out of the enclosed micro-environment. The overlap acts as a simple seal which is formed by taking advantage of the inherent self-adhesive nature of plastic surfaces.

Placement of flexible openings 18 on the surface of the barrier is not critical and may be done in any suitable configuration. The openings can take any conceivable shape and size that allows for adequate access to the patient. The size or shape of the openings can be variable, but the openings should be large enough to accommodate a human hand. The number of openings is preferably 4 so that at least two pairs of hands can have access at the same time. However, the number of openings can vary depending on the special needs of the user or market demand.

Figure 3:
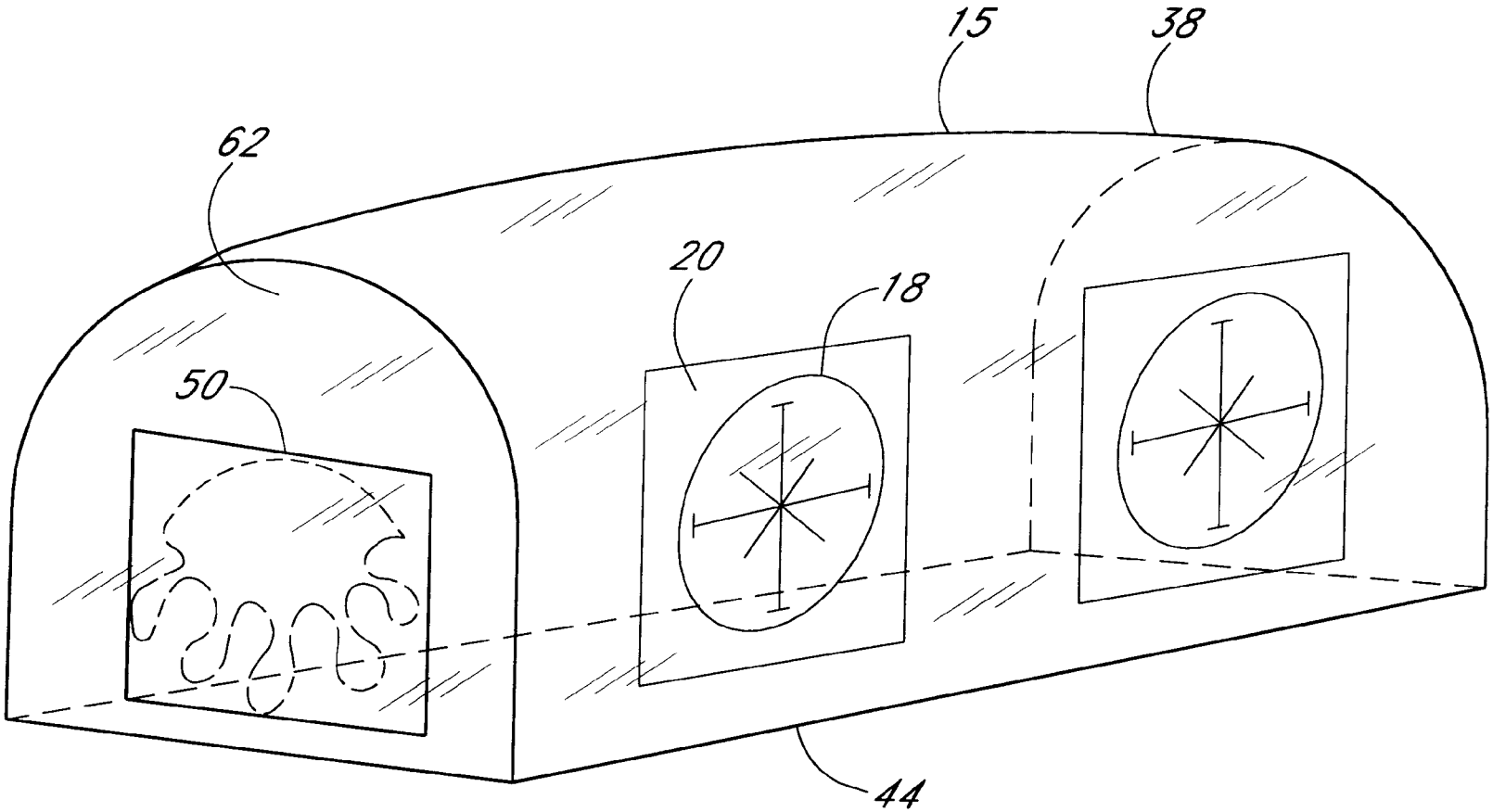
FIG. 3 is a perspective view of a right circular cylinder embodiment of the thermal barrier.
Figure 4:
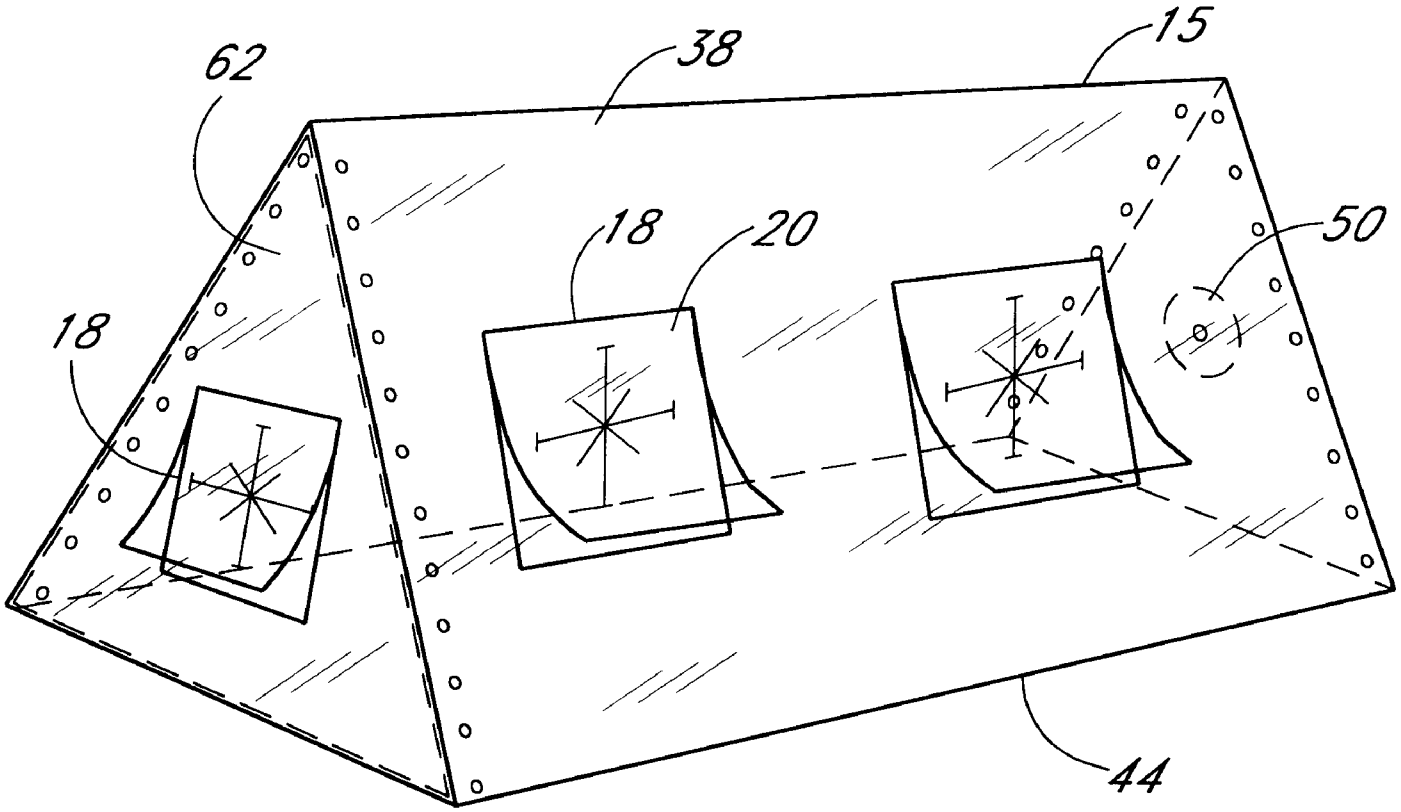
FIG. 4 is a perspective view of a tetrahedral embodiment of the thermal barrier.

Referring now to FIGS. 3 and 4 which illustrate perspective views of a right circular cylinder and a tetrahedral exemplary embodiment of the thermal and moisture barrier of the present invention, respectively. In each of the exemplary embodiments, cover 15 is formed into the desired shape using molded clear plastic, or other similar material. The shape can also be manufactured by fashioning seams 38 at edges 44. The seams can be either created, for example, by heat seal, hot glue, or radiofrequency bonding. The barriers, in each example, may be reinforced or made structurally rigid by using structural ridges (not shown) or other strengthening devices and methods. The exemplary embodiments may also have flat end portions 62 which can accommodate an extra opening 18 for accessing the patient, or an extra porthole 50 which provides access for IV lines, oxygen hoses, and monitor cables, and the like.

Figure 5:
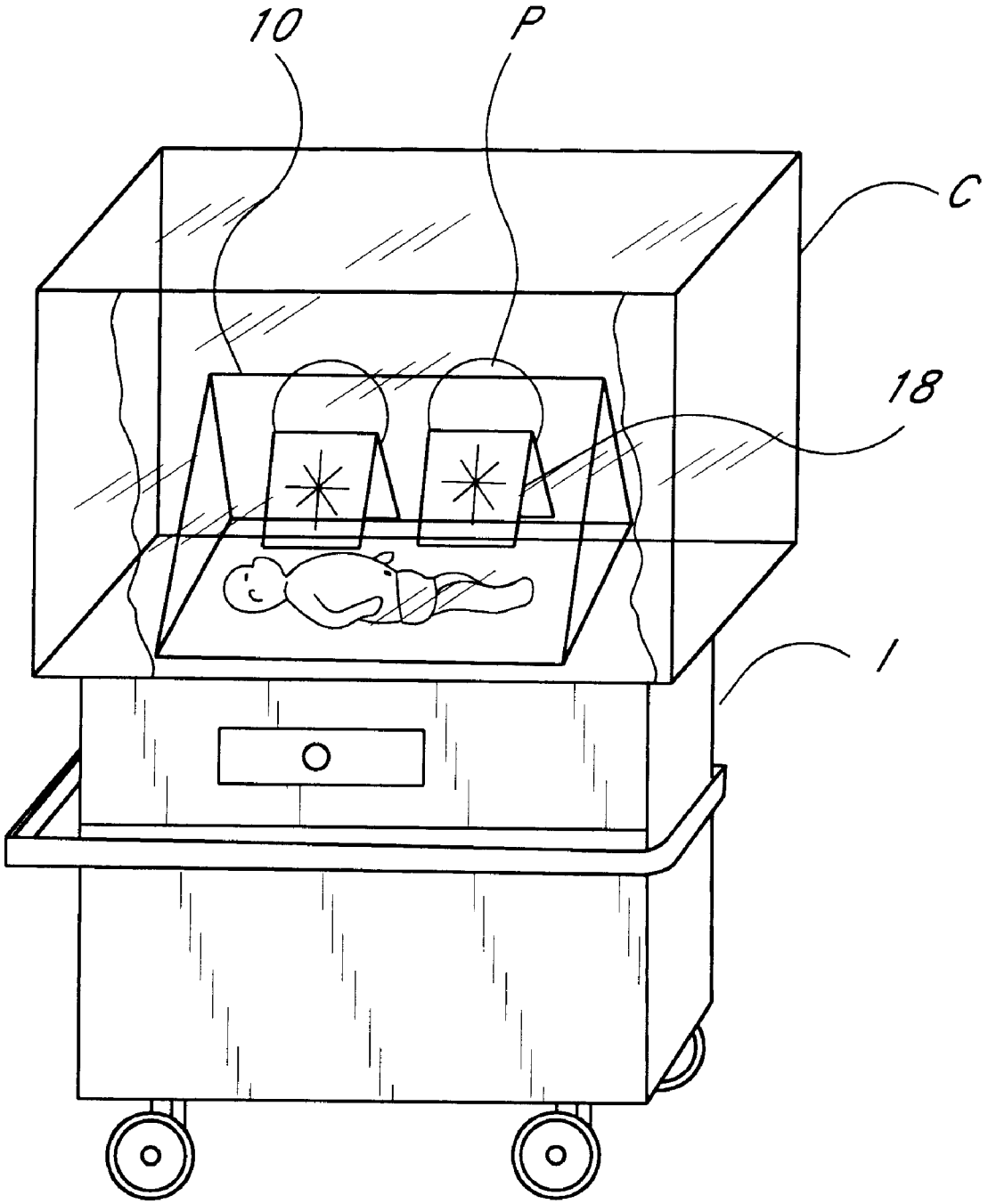
FIG. 5 is a perspective view of the embodiment of FIG. 4 placed in a typical incubator device.

FIG. 5 illustrates thermal and moisture barrier 10 of the present invention as used in an incubator I or similar device. The incubator cannot properly maintain a neutral thermal and humidified micro-environment for the extremely premature neonate because of its relatively large volume. Thermal barrier 10 captures a smaller volume of air within the incubator to provide this environment. Flexible openings 18, for access to the patient, can themselves be accessed through portholes P, typically found on incubator devices.

While this invention has been described in connection with specific embodiments thereof, it is obvious that modifications and changes therein may be made by those skilled in the art to which it pertains without departing from the scope of the invention. The scope is in no way to be limited except as set forth in the appended claims.

What is claimed is:

1. A barrier for use with a specialized heating apparatus used in the care of a neonatal infant having a bed portion with outwardly extending side guards substantially surrounding said bed portion, said barrier comprising:

a substantially flexible cover, said substantially flexible cover defining an enclosure when placed over said bed portion and said outwardly extending side guards to accommodate the neonatal infant;

at least one opening being configured to have a self-acting closure located through the cover and permitting manual access into the enclosure; and a flexible cover sheet positioned proximate to said at least one opening to overlap said at least one opening and form a seal when said self-acting closure is in a closed configuration.

2. The barrier of claim 1, wherein the self-acting closure comprises a manually penetrable diaphragm configured to open as an object or human hand is urged therethrough.

3. The barrier of claim 2, wherein the diaphragm comprises a resiliently flexible material extending across the opening and having slits therein.

4. The barrier of claim 3, wherein the slits extend radially outward having a common junction point located substantially centrally of the flexible opening.

5. The barrier of claim 1, wherein the cover comprises a substantially rectangular sheet, the sheet being pivotally coupled by a flexible seam at each of its edges to flap portions, the flap portions being configured to overhang a support framework to create a substantially thermal neutral environment within said enclosure.

6. The barrier of claim 1, wherein the cover defines a tetrahedral enclosure.

7. The barrier of claim 1, wherein the cover defines a half section of a truncated right circular cylinder enclosure.

8. The barrier of claim 1, wherein the cover comprises an optically transparent material.

9. A system for providing a neutral thermal environment comprising:

an infant radiant warmer having a bed portion with outwardly extending side guards;

a substantially flexible cover defining a substantially enclosed space when disposed over said bed portion and said outwardly extending side guards; and at least one opening located through the substantially flexible cover and permitting manual access into the substantially enclosed space.

10. The system of claim 9, having a diaphragm providing manually penetrable closure of the at least one opening.

11. The system of claim 10, wherein the diaphragm comprises a resiliently flexible sheet extending across the opening and having slits extending radially outward having common junction point located substantially centrally of the flexible opening.

12. The system of claim 9, wherein the substantially flexible cover defines a substantially rectangular sheet having a flexible seam at each of its edges coupled to a plurality of flap portions.

13. The system of claim 9, wherein the cover defines a section of a portion of a right circular cylinder enclosure.

14. The system of claim 9, wherein the cover defines a tetrahedral enclosure.

* * * * *